US012709433B2

(12) United States Patent
Klug

(10) Patent No.: US 12,709,433 B2
(45) Date of Patent: Aug. 18, 2026

(54) PROTECTIVE PACKAGING

(71) Applicant: Dorai Home, Inc., West Valley City, UT (US)

(72) Inventor: Jason Klug, Salt Lake City, UT (US)

(73) Assignee: Dorai Home, Inc., West Valley City, UT (US)

( * ) Notice: Subject to any disclaimer, the term of this patent is extended or adjusted under 35 U.S.C. 154(b) by 0 days.

(21) Appl. No.: 19/178,626

(22) Filed: Apr. 14, 2025

(65) Prior Publication Data

US 2025/0320022 A1 Oct. 16, 2025

Related U.S. Application Data

(60) Provisional application No. 63/633,687, filed on Apr. 12, 2024.

(51) Int. Cl.
*B65D 5/50* (2006.01)

(52) U.S. Cl.
CPC ..... *B65D 5/503* (2013.01)

(58) Field of Classification Search
CPC .... B65D 5/503; B65D 5/5052; B65D 5/5057; B65D 5/509; B65D 5/04; B65D 11/188; B65D 81/113
USPC ..... 206/454
See application file for complete search history.

(56) References Cited

U.S. PATENT DOCUMENTS 5,127,526 A * 7/1992 Vigue ..... B65D 85/42 206/419
5,706,951 A * 1/1998 Oinuma ..... H10P 72/1911 206/592
8,162,147 B1 * 4/2012 Ting ..... B65D 25/06 206/707
9,415,921 B2 * 8/2016 Marchetti ..... B65B 5/04
9,533,815 B2 * 1/2017 Hu ..... B65D 85/48
9,580,222 B2 * 2/2017 Knutz ..... B65D 9/06
10,065,783 B2 * 9/2018 Zhao ..... B65D 81/07
10,287,083 B2 * 5/2019 Zhao ..... B65D 81/263
10,947,032 B2 * 3/2021 Lv ..... B65D 21/0212
11,174,086 B2 * 11/2021 Huang ..... A45D 40/24
D959,270 S * 8/2022 Lee ..... D9/456
11,932,473 B2 * 3/2024 Cho ..... B65D 85/48
12,017,817 B2 * 6/2024 Hsu ..... B65D 1/34
12,043,447 B2 * 7/2024 Hoshino ..... B65D 25/107
12,103,729 B2 * 10/2024 Lee ..... B65D 1/34
12,103,735 B2 * 10/2024 Lavrykova-Marrain ..... B65D 25/107
12,291,388 B2 * 5/2025 Uchida ..... B65D 81/107
(Continued)

*Primary Examiner* — Ernesto A Grano

(74) *Attorney, Agent, or Firm* — Headland Law & Strategy; Matthew J. Smyth

(57) ABSTRACT

A system may include a slab, and a top cover and a bottom base configured to cooperate with each other to retain the slab. The bottom base may have a planar bottom surface, a plurality of bottom-slab-contacting regions that extend above the planar bottom surface by varying heights, and four bottom-base sides. The top cover may have a planar top surface, a plurality of top-slab-contacting regions that extend below the planar top surface by varying heights, and four top-cover sides. The bottom base and the top cover may be configured such to exert pressure on the slab in a first direction at each of the four corners and exert pressure in a second direction that is opposite the first direction at the central region, so as to deflect the slab in a bowl-like manner along a width and a length of the slab.

2 Claims, 8 Drawing Sheets

(56) References Cited

U.S. PATENT DOCUMENTS

| | | | | |
|---|---|---|---|---|
| 12,319,486 | B2 * | 6/2025 | Kamigaki | B65D 81/057 |
| 12,473,117 | B2 * | 11/2025 | Lin | B65D 1/36 |
| 12,507,775 | B2 * | 12/2025 | Hsu | A45C 11/00 |
| 2001/0020595 | A1 * | 9/2001 | Koike | B65D 81/025 206/592 |
| 2010/0236968 | A1 * | 9/2010 | De Jesus | B65D 81/1275 53/472 |
| 2014/0027337 | A1 * | 1/2014 | Marchetti | B65D 81/113 206/521 |
| 2014/0157730 | A1 * | 6/2014 | Lee | B65D 81/113 53/473 |
| 2015/0239640 | A1 * | 8/2015 | Smith | A61J 1/165 220/592.2 |
| 2016/0107828 | A1 * | 4/2016 | Zhao | B65D 85/38 206/454 |
| 2016/0122111 | A1 * | 5/2016 | Yang | B65D 85/38 206/523 |
| 2019/0374069 | A1 * | 12/2019 | Klug | A47K 3/002 |
| 2024/0406640 | A1 * | 12/2024 | Klug | B81B 7/0025 |

* cited by examiner

PROTECTIVE PACKAGING

CROSS REFERENCE TO RELATED APPLICATIONS

This application claims priority to U.S. Application Ser. No. 63/633,687, titled "Protective Packaging," filed on Apr. 12, 2024. This application incorporates the entire contents of the foregoing applications herein by reference.

TECHNICAL FIELD

Various implementations relate generally to protective packaging.

BACKGROUND

Certain products that have a flat, planar construction, such as, for example, diatomaceous earth slabs, may be susceptible to warping or deforming during shipment.

SUMMARY

Described herein are various protective packaging methods and systems. Some implementations apply a deflection force to planar products in a manner that maintains their integrity and function, as employed by an end user. For example, a bath mat comprising a diatomaceous earth slab may be packaged in a such a manner as to apply a slightly inverted-bowl deflection during shipment, such that in use, the bath mat has an initial convex shape. In some implementations, such packaging may prevent the diatomaceous earth slab from deforming in a concave manner that could reduce the utility or desirability of the slab to the end user. Other implementations merely protect product without applying a deflection force.

DETAILED DESCRIPTION

Figure 1A:
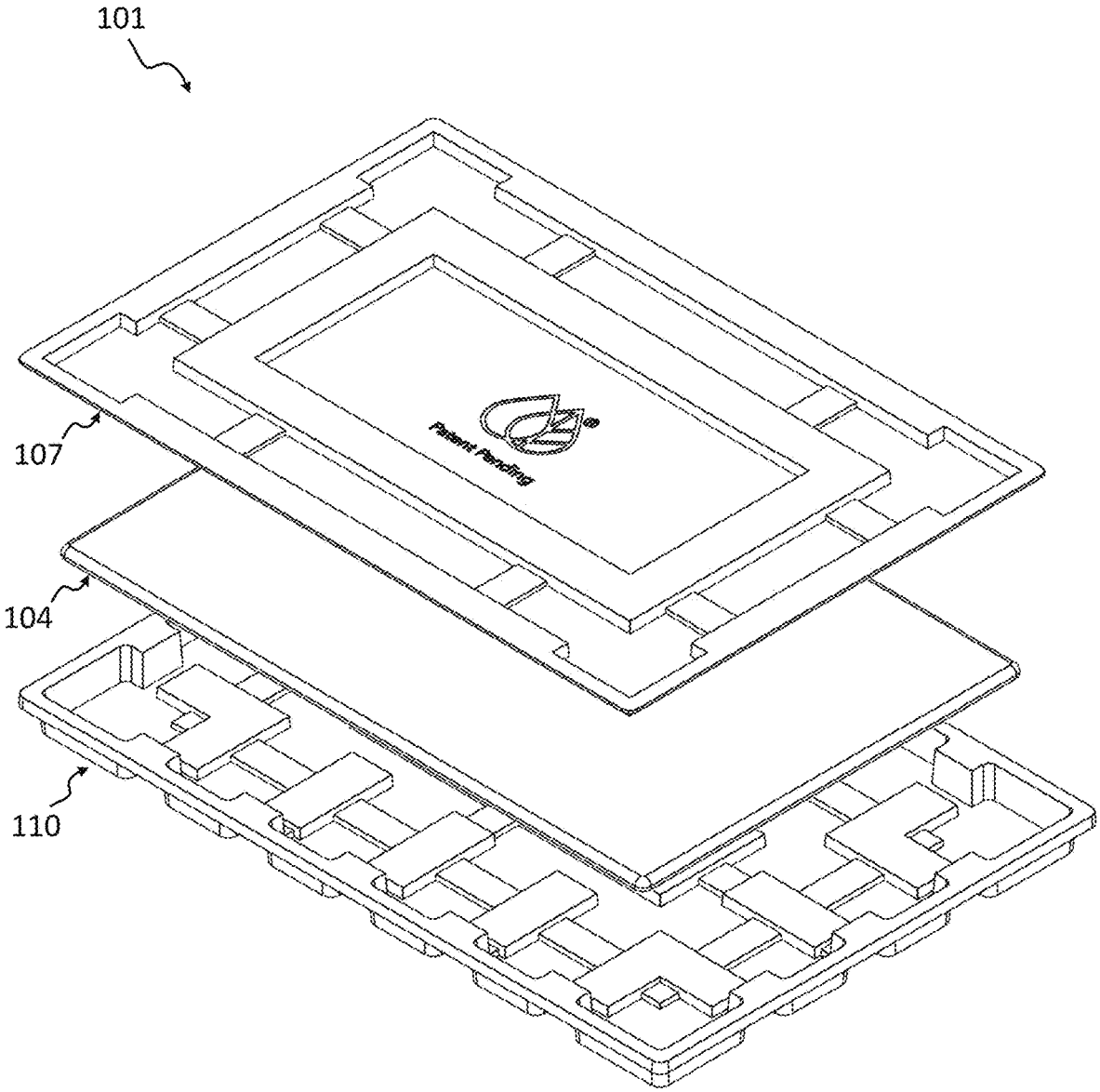
FIGS. 1A and 1B illustrate an exemplary system that includes a top cover, a slab and a bottom base.

FIG. 1A illustrates a system 101 that includes a slab 104, a top cover 107 and a bottom base 110. The slab 104 may be a diatomaceous earth slab 104 that is a component of another product, such as a bath mat or a dish mat. In such applications, the slab 104 may ideally be planar (i.e., be substantially characterized, geometrically, by a slab plane). The top cover 107 and bottom base 110 may be configured to be cooperatively disposed to retain the slab 104, for example, during shipment.

In some implementations, the slab 104 may be prone to deformation, and the top cover 107 and bottom base 110 may be configured to resist or counteract such deformation—for example, by applying a deflection or biasing force to the slab 104 to minimize the chance of the slab 104 taking on an undesirable or defective configuration. In some applications—for example, in which the slab is utilized as a component to a bath mat or dish mat—a concave shape may be undesirable. In such implementations, the top cover 107 and bottom base 110 may be configured to apply force to the slab 104 to bias it into a slight convex shape. In some implementations, the biasing force is applied in a manner that counteracts a natural deformation—for example, a deformation that may occur during shipment in high humidity or heat.

Figure 1B:
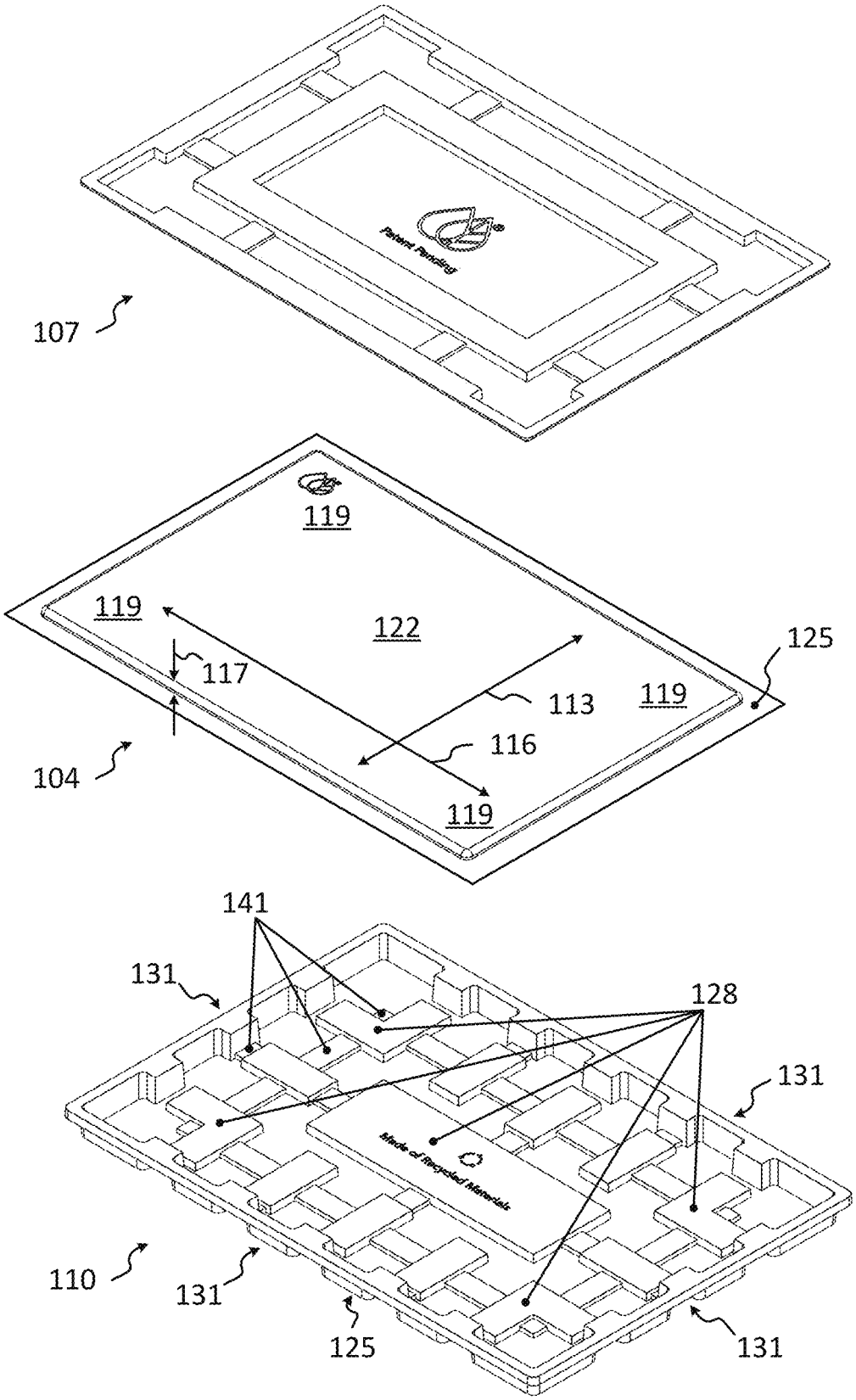
Figure 4:
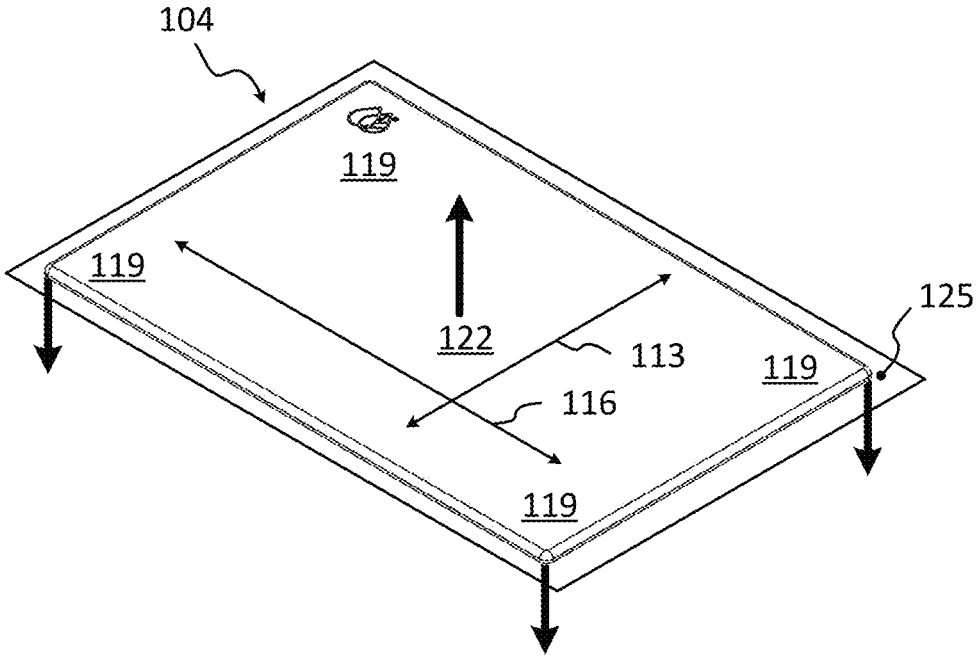
FIG. 4 illustrates exemplary forces or biases applied to a slab.

As illustrated in FIG. 1B, the slab 104 may have a rectangular shape and be characterized by a width 113 and a length 116, a substantially uniform thickness 117, and with four corners 119 and a central region 122, and further be defined (in its nominal or desired state) by a slab plane 125. ("Substantially uniform" may mean uniform across its dimensions within 1%, 5% or 10% of its nominal dimension.) Because the slab 104 may have a tendency to deform in a concave manner (e.g., in which the central region 122 dips below the plane 125 and/or the corners 119 rise above the plane 125), the system 101 may be configured to apply deflection force in the opposite direction—for example, such that a force is applied to the corners 119 and/or to the central region 122 so as to apply a deflection force to the slab 104 to bias it in a convex manner (as depicted in FIG. 4). Tendency to deform may be influenced by humidity, changes in humidity, gravity or a combination thereof, particularly during shipment.

Figure 2A:
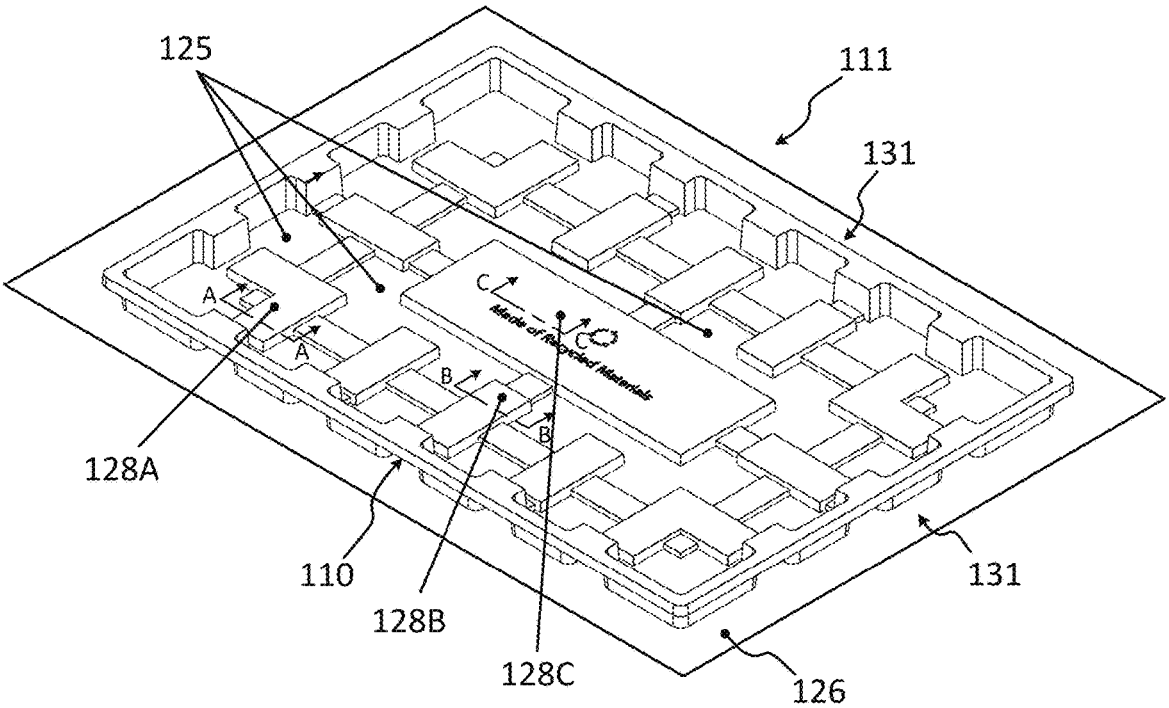
FIGS. 2A-2B illustrate additional details of the exemplary bottom base shown in FIGS. 1A and 1B.
Figure 2B:
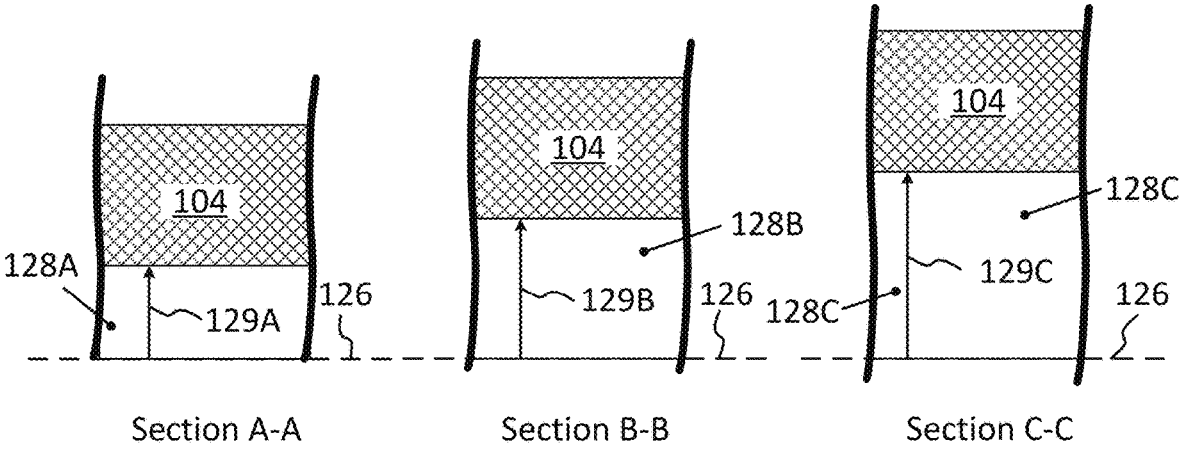

In some implementations, as depicted in FIGS. 2A-2B, the bottom base 110 has a three-dimensional bottom structure 111 having bottom-surface portions (e.g., portions 125) that are aligned along a bottom plane 126, and a plurality of bottom-slab-contacting regions 128A, 128B and 128C (collectively, 128) that are configured to contact the slab 104 at different heights, in some implementations. For example, in some implementations, as depicted in cross section in FIG. 2B (with slab 104 also shown), a first bottom-slab contacting region 128A extends above the bottom plane 126 by a first bottom height 129A; a second bottom-slab contacting region 128B extends above the bottom plane 126 by a second bottom height 129B that is greater than the first bottom height 129A; and a third bottom-slab-contacting region 128C extends above the bottom plane 126 by a third bottom height 129C that is greater than the second height 129B. The bottom base 110 may also include four bottom-base sides 131.

Figure 3A:
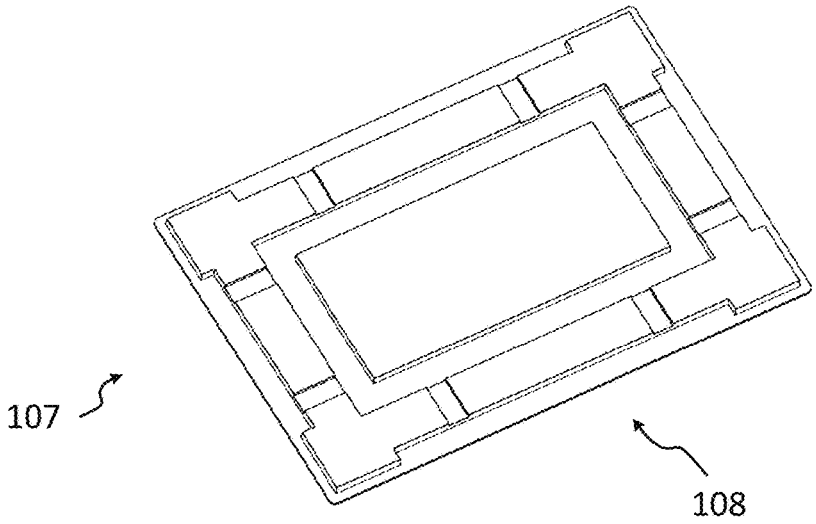
FIGS. 3A-3C illustrate additional details of the exemplary top cover shown in FIGS. 1A and 1B.
Figure 3B:
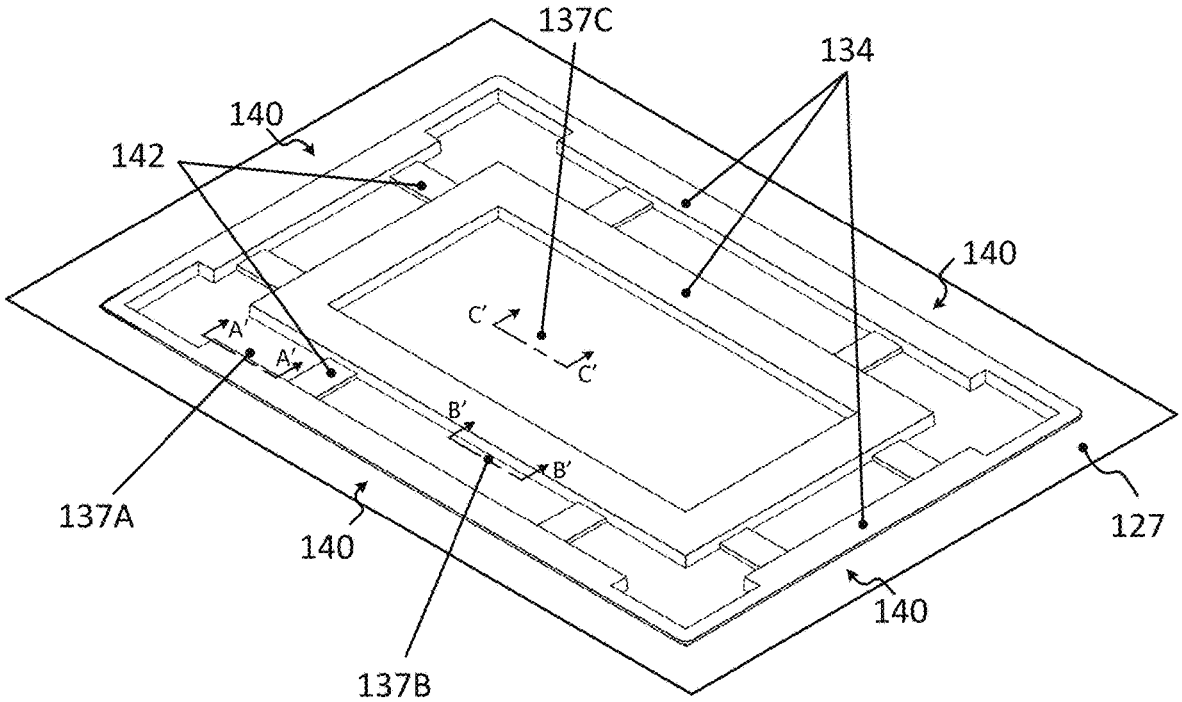
Figure 3C:
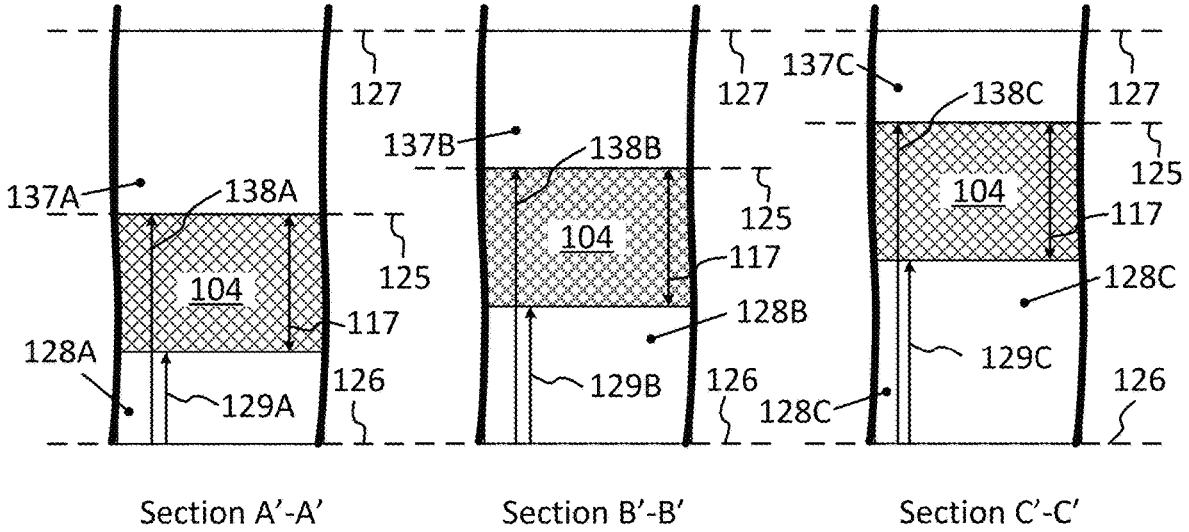

In some implementations, as depicted in FIGS. 3A-3C, a top cover 107 includes a three-dimensional top structure 108 having top-surface portions 134 that are aligned on a top plane 127. FIG. 3A shows a bottom of the top cover 107; FIG. 3B shows the top of the top cover 107; and FIG. 3C shows representative cross sections (with the slab 104 and corresponding bottom-slab-contacting regions also shown). A plurality of top-slab contacting regions 137A, 137B and 137C (collectively, 137) may include a first top-slab-contacting region 137A that is aligned over the first bottom-slab-contacting region 128A and that extends below the top plane 127 to a first top height 138A, relative to the bottom plane 126; a second top-slab-contacting region 137B that is aligned over the first bottom-slab-contacting region 129B and that extends below the top plane 127 to a second top height 138B, relative to the bottom plane 126; and a third top-slab-contacting region 137C that is aligned over the third bottom-slab-contacting region 128C and that extends below the top plane 127 to a third top height 138C, relative to the bottom plane 126C.

As depicted, in some implementations, differences between the first bottom height 129A and the first top height 138A, between the second bottom height 129B and the second top height 138B, and between the third bottom height 129C and the third top height 138C are substantially uniform and substantially equal to the uniform thickness 117.

As depicted in FIG. 4, the bottom-slab-contacting regions 128 and the top-slab-contacting regions 137 may be arranged to exert pressure on the slab 104 that is normal to the slab plane 125 and in a first direction at each of the four corners 119 and exert pressure that is normal to the plane 125 in a second direction that is opposite the first direction at the central region 122, so as to bias the slab 104 in a bowl-like manner along both the width 113 and the length 116.

In some implementations, the top cover 107 and bottom base 110 are disposed inside another carton (not shown; e.g., a corrugated cardboard carton). Such a carton may be configured to snugly retain the bottom base 110, the slab 104 and the top cover 107. That is, the carton may be dimensioned to just fit the top cover 107, the slab 104 and the bottom base, such that pressure is apply by the carton to the periphery of the top cover 107 and the bottom base 110, thereby holding the top cover 107 and the bottom base 110 together, retaining the slab 104 and applying deflection forces as described herein. The bottom base and the top cover may be further configured to support other bottom base/slab/top cover systems above or below (e.g., in a stacked configuration).

Figure 5A:
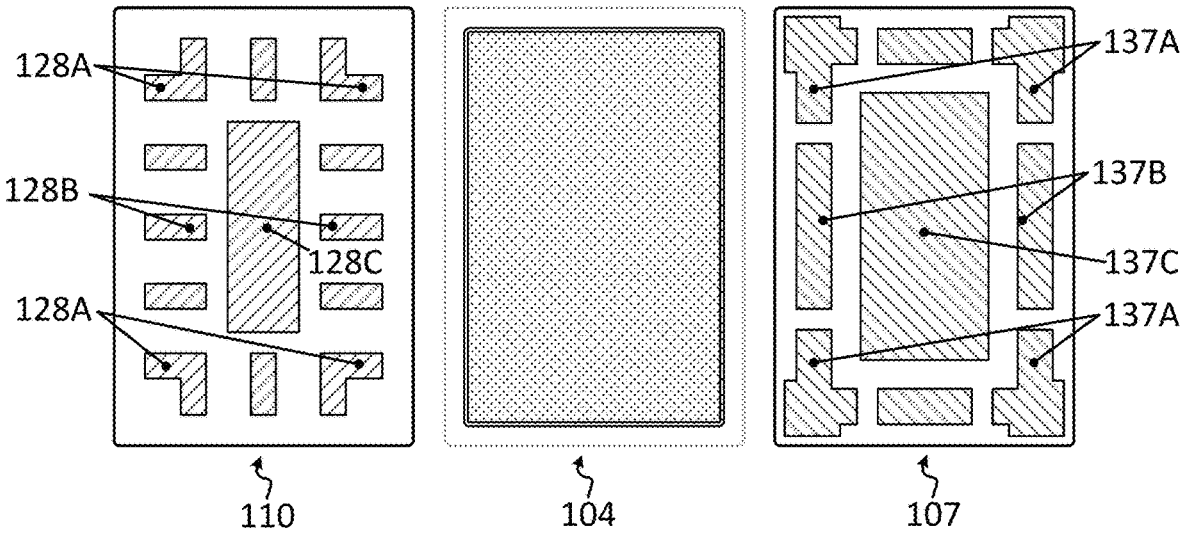
FIG. 5A shows a transparent top view of a bottom base, slab and top cover, along with representative slab-contacting regions.
Figure 5B:
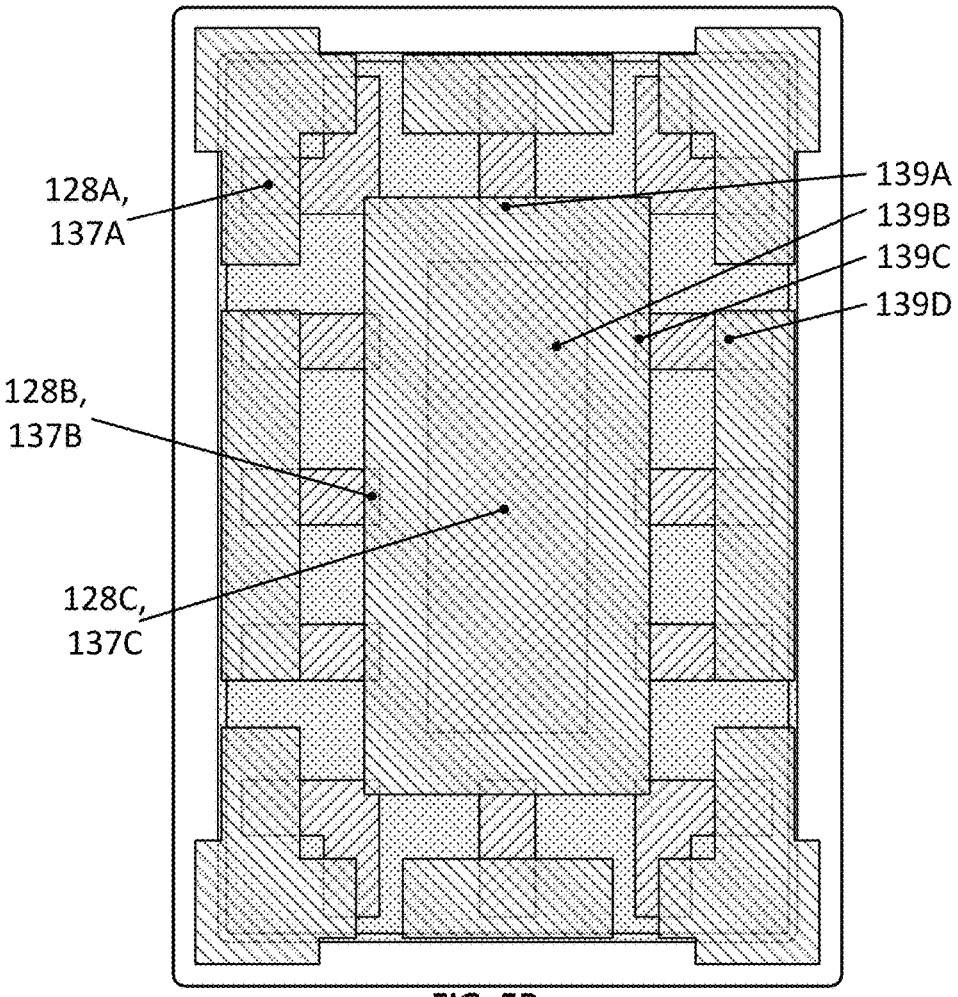
FIG. 5B shows a transparent top view of an overlay of an exemplary bottom base, slab and top cover.

FIG. 5A illustrates top, transparent views of the bottom base 110, the slab 104 and the top cover 107. Depicted in FIG. 5A are representative bottom-slab-contacting regions 128A, 128B and 128C (with additional symmetrical regions 128A, in some implementations) and representative top-slab contacting regions 137A, 137B and 137C (with additional symmetrical regions 137A, in some implementations). Additional regions of defined height and spacing may be provided, beyond just three regions, where bottom-slab-contacting regions are directly below (or closely adjacent to) corresponding top-slab-contacting regions, such that the slab is "pinched" between corresponding regions. For example, in the transparent overlay view of FIG. 5B, additional overlapping regions 139A, 139B, 139C and 139D are annotated. Each such overlapping region may correspond to bottom-slab-contacting and top-slab-contacting regions with precisely defined heights to apply a specific pressure or bias to a slab contained therebetween. Thus, in some implementations, three different regions and corresponding heights may be defined; in other implementations, four, five, six, seven, etc. regions with corresponding heights may be defined.

In various implementations, different levels of bias pressure may be applied to a slab, and various pressure profiles and support profiles may be provided. Such implementations may protect and pre-bias slabs during storage and transport, such that any deformation (e.g., caused by humidity, heat, gravity, movement, settling, etc.) may be counteracted, such that the slab as delivered to an end user is in a desired planar state or settles/returns to such a state after being unpackaged.

In some implementations, additional support structures may be provided, such as the support structures 141 shown in FIG. 1B and the support structures 142 shown in FIG. 3B. Such support structures may maintain spacing among the various slab-contacting surfaces relative to top or bottom planes and relative to each other.

Figure 6:
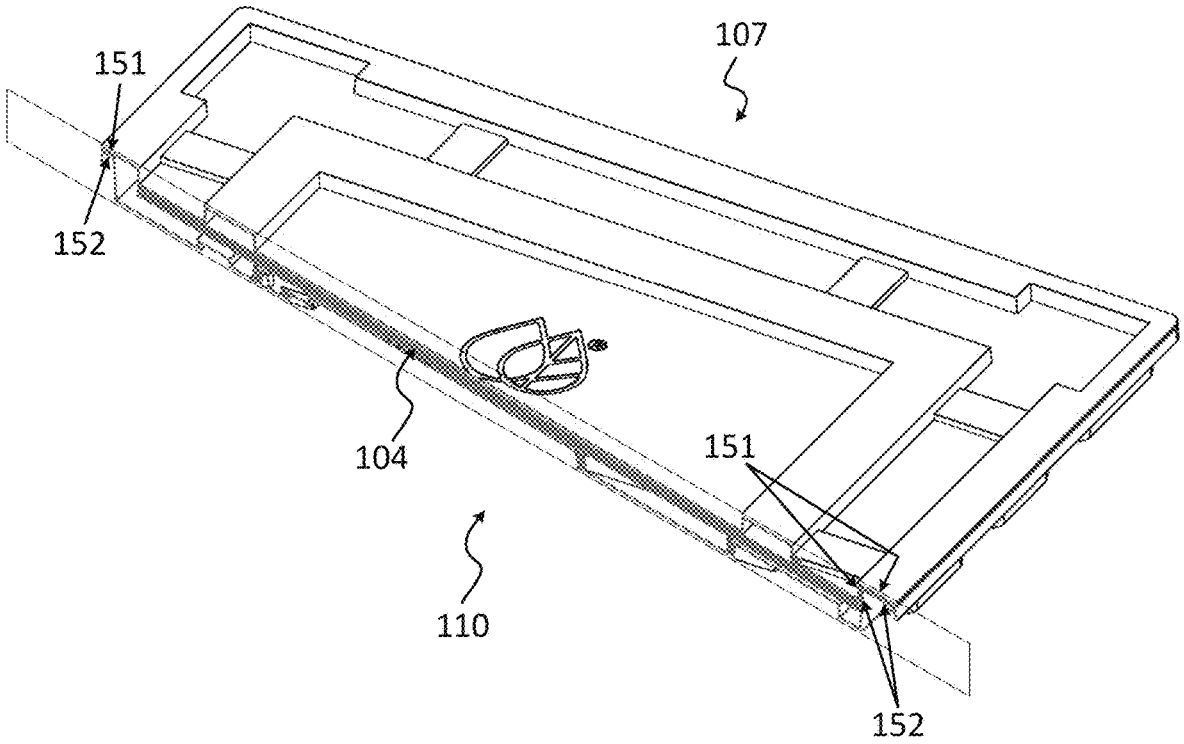
FIG. 6 illustrates corresponding interface surfaces on the bottom base and top cover.

FIG. 6 illustrates interface surfaces 152 on the bottom base 110 and corresponding interface surfaces 151 on the top cover 107 that may be aligned to contact each other with frictional force to maintain the top cover 107 and bottom base 110 in a closed configuration and in a manner that retains the slab 104 between the top cover 107 and the bottom base 110. Such interfacing surfaces 151 and 152 may be provided at multiple locations throughout the top cover 107 and bottom base 110, and they, in conjunction with the support structures 141 and 142, the three-dimensional top structure 108, and three-dimensional bottom structure 111, may further maintain the system in a closed configuration and one that exerts intended forces or bias pressures at various points on the slab 104.

Several implementations have been described with reference to exemplary aspects, but it will be understood by those skilled in the art that various changes may be made and equivalents may be substituted for elements thereof without departing from the contemplated scope. In general, any reference to "about" or "approximately" may mean within 1%, or 5%, or 10%, or 20%, or 50% of a nominal value. "Substantially" may mean within 99%, 95%, 90%, 80% or 50% of a nominal value. "Slight" or "slightly" may mean modification of a nominal value or state by 1%, 5%, 10% or 20%.

Many other variations are possible, and modifications may be made to adapt a particular situation or material to the teachings provided herein without departing from the essential scope thereof. Therefore, it is intended that the scope include all aspects falling within the scope of the appended claims.

What is claimed is:

1. A system comprising:

a slab having a rectangular shape with a width, a length, a uniform thickness, four corners and a central region, and being characterized by a plane that is parallel to both the width and the length; and a top cover having a plurality of top-cover interface surfaces, and a bottom base having a plurality of bottom-base interface surfaces, wherein the top-cover interface surfaces and the bottom-base interface surfaces are aligned to contact each other with frictional force to maintain the top cover and bottom base in a closed configuration and in a manner that retains the slab between the top cover and the bottom base;

wherein the bottom base comprises a three-dimensional bottom structure having bottom-surface portions that are aligned along a bottom plane and a plurality of bottom-slab-contacting regions that include (i) a first bottom-slab-contacting region that extends above the bottom plane by a first bottom height, (ii) a second bottom-slab-contacting region that extends above the bottom plane by a second height that is greater than the first height, and (iii) a third bottom-slab-contacting region that extends above the bottom plane by a third height that is greater than the second height;

wherein the top cover comprises a three-dimensional top structure having top-surface portions that are aligned on a top plane and a plurality of top-slab contacting regions that include (a) a first top-slab-contacting region that is aligned over the first bottom-slab-contacting region and that extends below the top plane to a first top height, relative to the bottom plane; (b) a second top-slab-contacting region that is aligned over the first bottom-slab-contacting region and that extends below the top plane to a second top height, relative to the bottom plane; and (c) a third top-slab-contacting region that is aligned over the third bottom-slab-contacting region and that extends below the top plane to a third top height, relative to the bottom plane;

wherein differences between (x) the first bottom height and the first top height, (y) the second bottom height and the second top height, and (z) the third bottom height and the third top height are substantially uniform and substantially equal to the uniform thickness; and wherein the plurality of bottom-slab-contacting regions and the plurality of top-slab-contacting regions are arranged to exert pressure on the slab that is normal to the plane and in a first direction at each of the four corners and (ii) exert pressure that is normal to the plane in a second direction that is opposite the first direction at the central region, so as to bias the slab in a bowl-like manner along both the width and the length.

2. The system of claim 1, further comprising a corrugated cardboard carton configured to snugly retain the bottom base, the slab and the top cover.

* * * * *